US005803025A

United States Patent [19]

Feucht

[11] Patent Number: 5,803,025

[45] Date of Patent: Sep. 8, 1998

[54] BLOWBY DISPOSAL SYSTEM

[75] Inventor: Dennis D. Feucht, Morton, Ill.

[73] Assignee: Caterpillar Inc., Peoria, Ill.

[21] Appl. No.: 767,998

[22] Filed: Dec. 13, 1996

[51] Int. Cl.[6] ..... F01M 13/00

[52] U.S. Cl. ..... 123/41.86; 60/283

[58] Field of Search ..... 123/41.86; 60/283

[56] References Cited

U.S. PATENT DOCUMENTS

| | | | |
|---|---|---|---|
| 2,849,994 | 9/1958 | Barker | 123/41.86 |
| 3,306,033 | 2/1967 | Cornelius | 60/283 |
| 3,662,723 | 5/1972 | Buhl | 123/119 |
| 3,721,069 | 3/1973 | Walker | 55/319 |
| 3,834,156 | 9/1974 | Cutler et al. | 60/597 |
| 3,978,671 | 9/1976 | Gonzalez | 60/598 |
| 4,092,962 | 6/1978 | Beaton et al. | 123/133 |
| 4,167,164 | 9/1979 | Bachmann | 123/119 |
| 4,184,858 | 1/1980 | Walker | 55/228 |
| 4,256,064 | 3/1981 | Thorn | 123/59 |
| 4,269,607 | 5/1981 | Walker | 55/1 |
| 4,557,226 | 12/1985 | Mayer et al. | 123/41.86 |
| 4,724,807 | 2/1988 | Walker | 123/196 |
| 4,962,745 | 10/1990 | Ohno et al. | 123/533 |
| 5,205,265 | 4/1993 | Kashiyama et al. | 123/570 |
| 5,456,239 | 10/1995 | Henderson et al. | 123/563 |
| 5,479,907 | 1/1996 | Walker, Jr. | 123/573 |
| 5,487,371 | 1/1996 | Beckman et al. | 123/572 |

FOREIGN PATENT DOCUMENTS

| | | | |
|---|---|---|---|
| 562 956 | 6/1975 | Switzerland | 60/283 |
| 1 534 195 | 1/1990 | U.S.S.R. | 123/41.86 |

*Primary Examiner*—Noah P. Kamen
*Attorney, Agent, or Firm*—Alan J. Hickman

[57] ABSTRACT

A blowby disposal system for disposing of blowby contaminants from a blowby mixture contained within a crankcase chamber of an internal combustion engine includes an air-oil separator, a passage to transport the blowby mixture from the crankcase chamber to the air-oil separator, a pump, and a passage to transport the blowby contaminants from the air-oil separator to the pump. The pump directs the stream of contaminants into the exhaust system of the engine where it becomes a portion of the overall exhaust emission stream. Degradation of the engine components and the turbocharger components is reduced because the blowby contaminants are not introduced into these components through the air intake system.

11 Claims, 3 Drawing Sheets

44
30
32
10
36
50
34
16
46
38
22
58
37
26
40
52
18
25
24
14
28
12
27
23
42
20

BLOWBY DISPOSAL SYSTEM

TECHNICAL FIELD

This invention relates generally to a system for disposing of blowby mixture from an internal combustion engine and more particularly to a disposal system having a pump which pumps the blowby mixture into the exhaust system of the engine.

BACKGROUND ART

Internal combustion engines, including diesel and gasoline engines, produce a blowby mixture during operation of the engine. This mixture contains air which is "blown" by the piston rings and valve guides of the engine and deposited in the crankcase chamber, oil mist produced within the crankcase chamber, and some water vapors. In the early years of the internal combustion engine, such blowby mixture was drained off from the crankcase chamber through a breather and directed to the atmosphere toward the ground. In today's environmentally conscious society it is desirable to handle engine blowby as part of the total engine emission output.

Alternate methods are and have been proposed to dispose of such blowby mixtures. Various air-oil mixture separators have been known and used in the past. Some of these devices were somewhat effective while others were unsatisfactory because they did not effectively remove the oil from the mixture stream entering the separators. The performance of such separators degraded rapidly because of the build-up of contaminants on the components of the separators. In most of the prior art air-oil separators, the blowby stream, upon exiting the separator, is inducted into the inlet air stream of the engine air cleaner or turbocharger inlet. This blowby stream is then mixed with incoming air and fuel and supplied for combustion to the engine. Because this blowby stream still contains residual oil particulate and other contaminates, damage to various engine components can occur. These components can include the turbocharger compressor wheel, the air inlet aftercooler, the inlet manifold, the valves, the cylinder components, and other engine parts.

The present invention is directed to overcoming one or more of the problems set forth above.

DISCLOSURE OF THE INVENTION

In one aspect of the present invention, a blowby disposal system for disposing of oil and contaminants from a contaminant mixture of an internal combustion engine includes an air-oil separator, a blowby pump, an exhaust system, and a plurality of passages connecting the engine, the separator, the pump, and the exhaust system. The air-oil separator separates a large amount of the oil from the mixture and this oil is transported back to the crankcase chamber. The remainder of the mixture is transported from the separator by a blowby pump and deposited into the engine exhaust system. This portion of the mixture therefore becomes a portion of the overall exhaust emission stream. By depositing the contaminant mixture into the exhaust rather than the intake of the engine, damage to various engine components due to the mixture is eliminated.

BEST MODE FOR CARRYING OUT THE INVENTION

Figure 1:
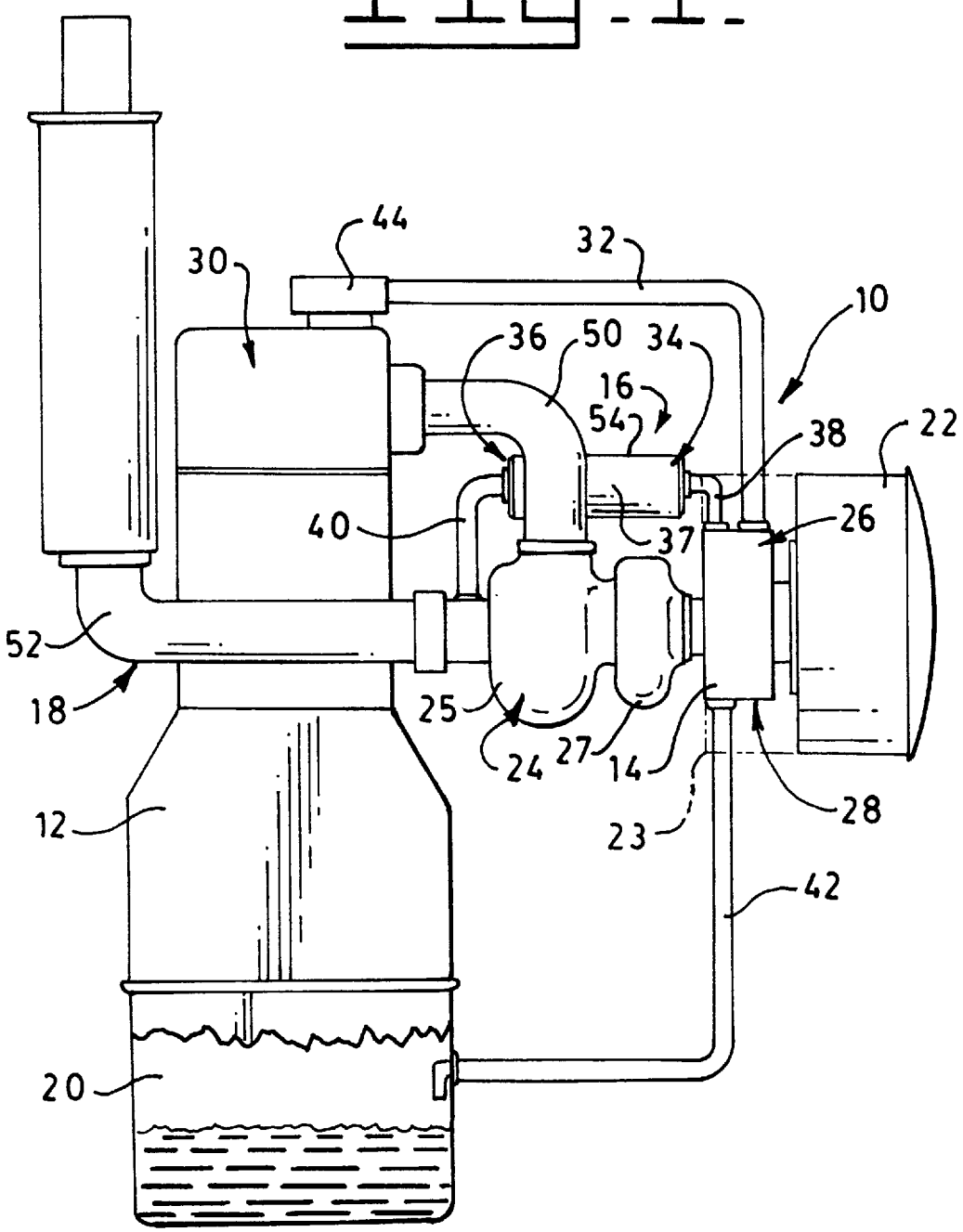
FIG. 1 is a diagrammatic elevational view of an internal combustion engine incorporating an embodiment of the present invention utilizing a motor driven air pump as the blowby pump.

With reference to the drawings, a blowby disposal system 10 for an internal combustion engine 12 includes an air-oil separator 14, a blowby pump 16, and an exhaust system 18. The engine 12 includes a crankcase chamber 20, an air cleaner 22, and a turbocharger 24 having a turbine section 25 and a compressor section 27. The turbine section is connected in the exhaust system 18 between a turbine inlet passage 50 (high pressure engine exhaust gas passage) and an exhaust pipe 52. The compressor section 25 is connected to an inlet of the engine 12 in a conventional manner. During operation of the engine 12, blowby produces a containment mixture within the crankcase chamber 20. The blowby disposal system 10 disposes of the oil and contaminants within this mixture.

The air-oil separator 14 has first and second portions 26,28 with the first portion 26 connected to the top portion 30 of the engine 12 by a first passage 32. The blowby pump 16 has first and second end portions 34,36 and a middle portion 37 located between the first and second end portions 34,36. The blowby pump is positioned intermediate the exhaust system 18 and the air-oil separator 14. The blowby pump 16 can be of various types, including a motor driven air pump 54 (shown in FIG. 1), an air injector pump 56 (shown in FIG. 3), or a gas injector pump 58 (shown in FIG. 2). Air or gas injector pumps 56,58 utilize high pressure air (higher in pressure than the exhaust pipe 52) to create a pressure differential between the first an second end portions 34,36 and thereby cause a pumping action with fluid introduced at the middle portion 37.

Figure 2:
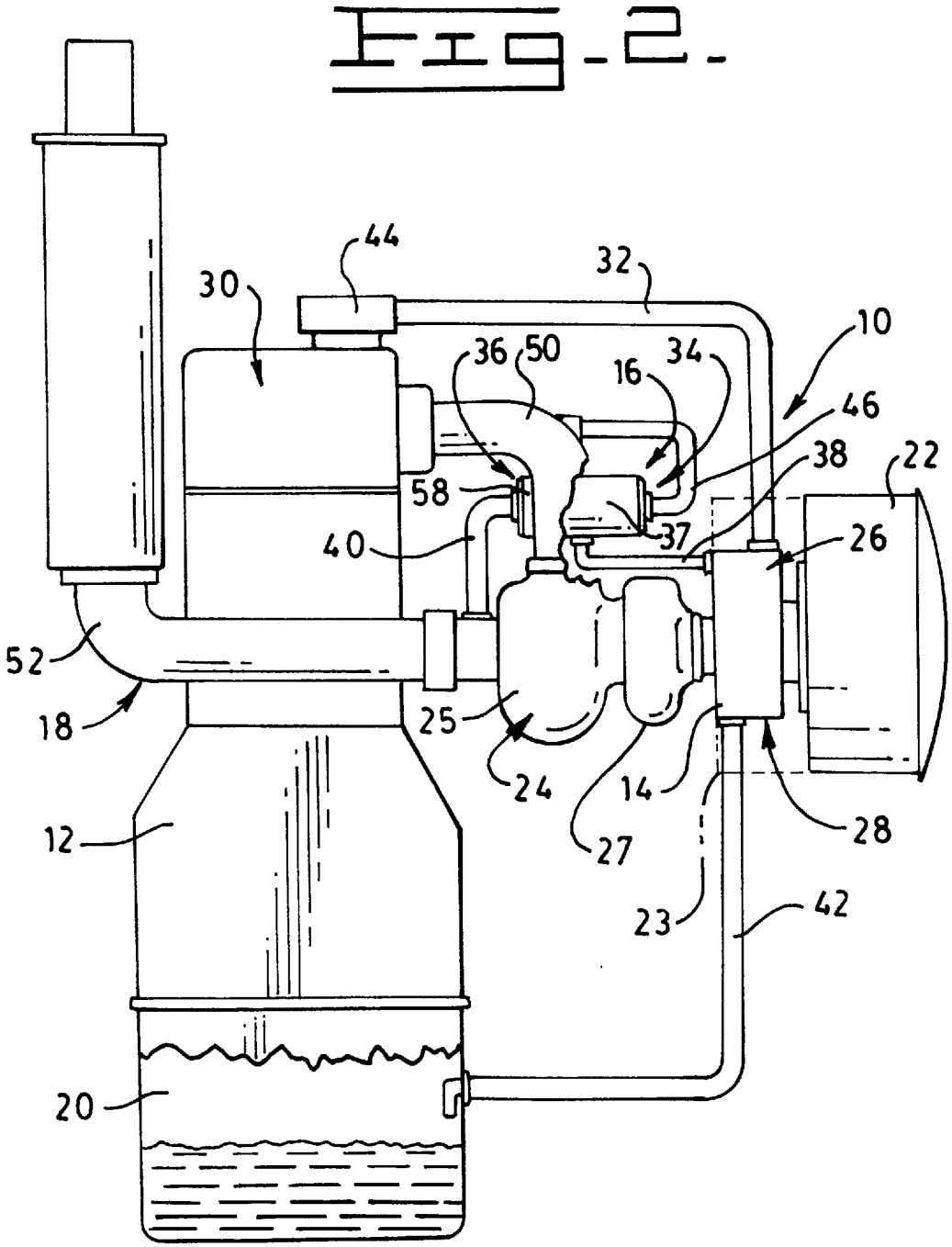
FIG. 2 is a diagrammatic elevational view of embodiment of the present invention showing an exhaust gas injector as the blowby pump.
Figure 3:
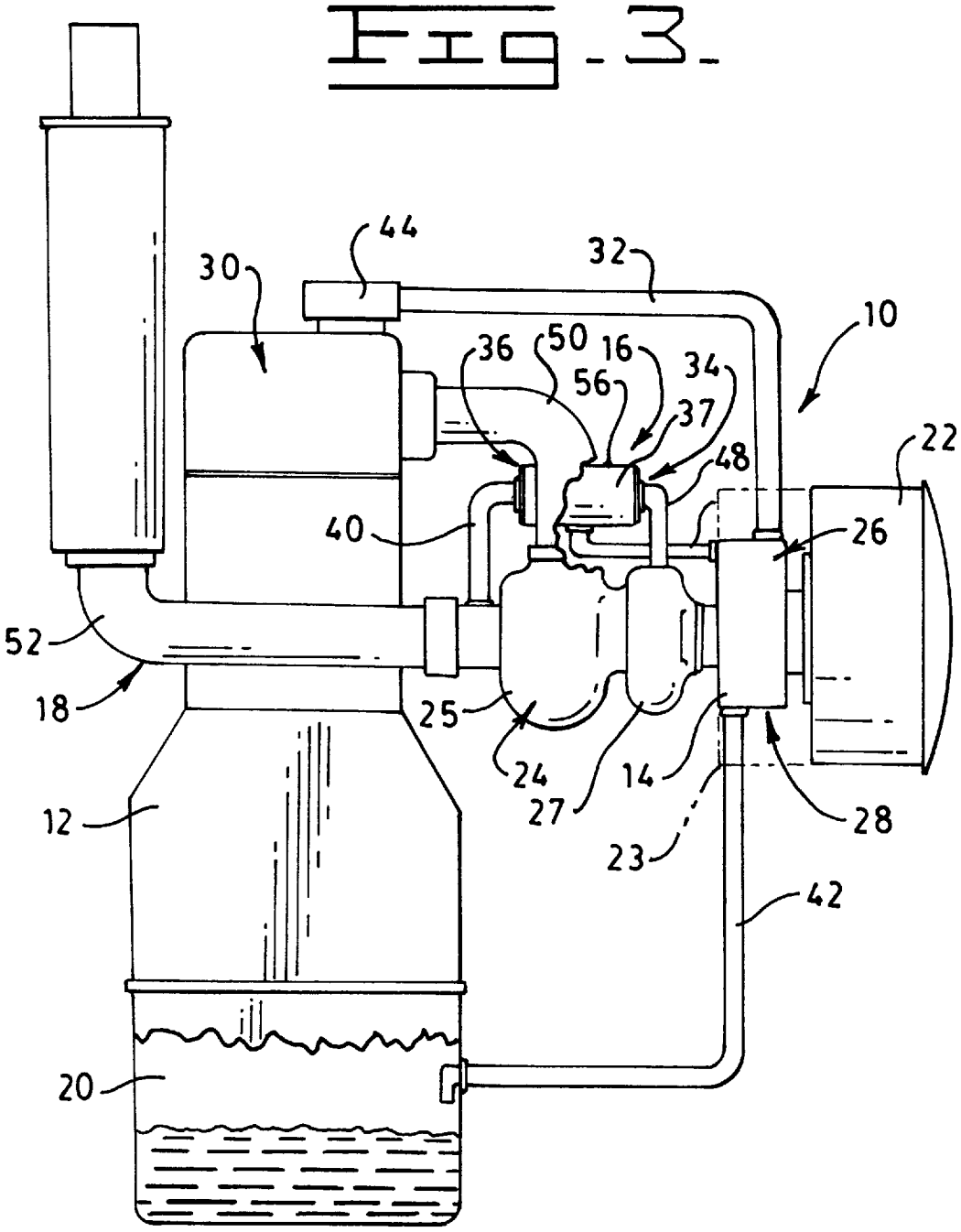
FIG. 3 is a diagrammatic elevational view of an embodiment of the present invention showing an air injector as the blowby pump.

As shown in FIG. 1, a second passage 38 connects the first end portion 34 of the motor driven air pump 54 to the first portion 26 of the separator 14. A third passage 40 connects the second end portion 36 of the pump 54 to the exhaust system 18. As shown in FIGS. 1,2 and 3, the second portion 28 of the separator 14 is connected to the crankcase chamber 20 by a fourth passage 42.

Referring to FIG. 2, the first end 34 of the gas injector pump 58 is connected to the turbine inlet passage 50 by an exhaust gas passage 46. The middle portion 37 of the pump 58 is connected to the first portion 26 of the air oil separator 14 by the second passage 38. The high pressure gas introduced to the first end portion 34 by the exhaust gas passage 46 provides sufficient pressure to produce a pressure differential between a first end and second ends 34,36 of the gas injector pump 58 and draw blowby contaminant mixture from the air oil separator 14.

Referring to FIG. 3, the first end 34 of the air injector type pump 56 is connected to the compressor section 27 of the turbocharger 24 by a compressor passage 48. The middle portion 37 of the pump 56 is connected to the first portion 26 of the air oil separator 14 by the second passage 38. The compressed boost air introduced to the first end portion 34 by compressor passage 48 provides sufficient pressure to produce a pressure differential between a first end and second ends 34,36 of the air injector pump 56 and draw blowby contaminant mixture from the air oil separator 14.

Although the drawings illustrates a single air-oil separator 14, two or more separators can be used, and in most cases, a single blowby pump 16 can pump the contaminant mixture from the plurality of separators 14. Advantageously, the air-oil separator 14 and the air cleaner 22 can be positioned within a common housing 23 (shown in phantom). Such a design uses the atmospheric temperature of the air inlet to reduce the wall temperature of the air-oil separator 14 to help trap small particles of oil out of the blowby mixture. A blowby pressure control valve 44 can also be used advantageously to control the pressure of the blowby mixture. Preferably, the pressure control valve 44 is positioned intermediate the engine 12 and the air-oil separator 14.

INDUSTRIAL APPLICABILITY

With reference to the drawings and the previous detailed description, the subject blowby disposal system 10 is particularly useful for disposing of oil and contaminants from a blowby mixture contained within a crankcase chamber 20 of an internal combustion engine 12. During operation of the engine 12, blowby produces a contaminant mixture within the crankcase chamber 20. This mixture includes air, combustion products, oil mist and perhaps other contaminants. This mixture is directed to the top portion 30 of the engine 12 through internal engine passages and into the first passage 32 and then into the air-oil separator 14. In the separator 14, a large amount of the oil in the blowby mixture is separated out and the oil collects in the second portion 28 of the separator 14. This separated oil flows through the fourth passage 42 and into the crankcase chamber 20 and mixes with the oil therein.

The remainder of the blowby contaminant mixture is drawn out of the first portion 26 of the separator 14 by the blowby pump 16. This blowby mixture flows from the separator 14 through the second passage 38, through the pump 16 and into the third passage 40. From the third passage 40, the contaminant mixture is deposited into the exhaust system 18 directly down stream of the turbocharger 24, ahead of any subsequently installed exhaust piping components, where it mixes with the exhaust stream and is treated as a portion of the overall exhaust emission stream.

Other aspects, objects and advantages of this invention can be obtained from a study of the drawings, the disclosure and the appended claims.

I claim:

1. A blowby disposal system for disposing of oil and contaminants from a contaminant mixture contained within a crankcase chamber of an internal combustion engine, comprising:

an air-oil separator having a first portion;

a first passage connecting the engine to the first portion of said separator;

an exhaust system;

a blowby pump having first and second end portions, a middle portion and being positioned intermediate said exhaust system and said air-oil separator;

a second passage connecting the blowby pump to said separator first portion;

a third passage connecting said second end portion of said blowby pump to said exhaust system; and an air cleaner connected to the air-oil separator and passing inlet air through said separator.

2. A blowby disposal system, as set forth in claim 1, wherein said blowby pump is a motor driven air pump, said second passage being connected to the first end portion of the blowby pump.

3. A blowby disposal system, as set forth in claim 1, including a turbocharger having a compressor section and being connected to said engine, a compressor passage connected to the compressor section and the first end portion of the blowby pump, said second passage being connected to the middle portion of the blowby pump.

4. A blowby disposal system, as set forth in claim 3, wherein said blowby pump is an air injector pump powered by said turbocharger.

5. A blowby disposal system, as set forth in claim 1, wherein said turbocharger has a turbine section and said exhaust system has a turbine inlet passage connected to the engine and an exhaust passage, said turbine section being connected in said exhaust system between the turbine inlet passage and the exhaust passage and being powered by exhaust gasses in said exhaust system, including an exhaust gas passage connected between the turbine inlet passage and the first end portion of said blowby pump, said second passage being connected to the middle portion of the blowby pump.

6. A blowby disposal system, as set forth in claim 5, wherein said blowby pump is a gas injector pump powered by exhaust gases in said exhaust system.

7. A blowby disposal system, as set forth in claim 1, including a plurality of air-oil separators, each of said separators being connected to the first end portion of said blowby pump.

8. A blowby disposal system, as set forth in claim 1, wherein said air-oil separator includes a second portion and including a fourth passage connecting said second portion to the crankcase chamber.

9. A blowby disposal system, as set forth in claim 1, wherein said internal combustion engine has a top portion and including a pressure control valve connected to said top portion and said first passage, said pressure control valve controlling the pressure of the blowby contaminant mixture.

10. A method of removing contaminants from a contaminant mixture from the crankcase chamber of an internal combustion engine and disposing of said contaminants into the exhaust system of the engine, comprising the steps of:

transporting the contaminant mixture from the crankcase chamber to an inlet of an air-oil separator;

separating said mixture into first and second portions, said first portion having a large amount of the oil;

depositing said first portion in the bottom portion of said separator;

transporting said oil from said separator to said crankcase chamber;

transporting said second portion, including air and contaminants, from said separator to a blowby pump; and transporting said second mixture portion from said pump into the exhaust system of the engine.

11. A blowby disposal system for disposing of oil and contaminants from a contaminant mixture contained within a crankcase chamber of an internal combustion engine, comprising:

an air-oil separator having a first portion;

a first passage connecting the engine to the first portion of said separator;

an exhaust system;

a blowby pump having first and second end portions, a middle portion and being positioned intermediate said exhaust system and said air-oil separator;

a second passage connecting the blowby pump to said separator first portion;

a third passage connecting said second end portion of said blowby pump to said exhaust system; and an air cleaner having a housing and being connected to the air-oil separator, said air cleaner passing inlet air through said separator, said separator being positioned within said housing.

* * * * *